United States Patent [19]

Schwartz et al.

[11] 4,336,621

[45] Jun. 29, 1982

[54] DISPOSABLE ORTHOPEDIC OVERMATTRESS FOR ARTICULATED BEDS

[76] Inventors: Donald R. Schwartz, 1501 S. Beverly Dr., Los Angeles, Calif. 90035; Stuart H. Baumgard, 16031 Jeanne La., Encino, Calif. 91436

[21] Appl. No.: 124,320

[22] Filed: Feb. 25, 1980

[51] Int. Cl.[3] ..... A61G 7/00; A61G 7/04; A47C 27/16

[52] U.S. Cl. ..... 5/446; 5/67; 5/464; 5/465; 5/496

[58] Field of Search ..... 5/67, 68, 244, 446, 5/460, 465, 487, 420, 497, 498, 499, 501, 462, 471, 496

[56] References Cited

U.S. PATENT DOCUMENTS

| | | | |
|---|---|---|---|
| 46,569 | 2/1865 | Mathews | 5/68 |
| 1,892,841 | 11/1933 | Kaufmann | 5/484 |
| 1,959,920 | 5/1934 | Kaiser | 5/498 |
| 2,801,427 | 8/1957 | Crocker | 5/483 |
| 3,110,042 | 11/1963 | Slemmons | 5/462 |
| 3,447,170 | 6/1969 | Spitz | 5/465 |
| 3,538,521 | 11/1970 | Basner | 5/462 |
| 3,646,624 | 3/1972 | Zipf | 5/487 |
| 3,846,857 | 3/1972 | Weinstock | 5/464 |
| 3,893,198 | 7/1975 | Blair | 5/446 |
| 4,244,066 | 1/1981 | Rukawina | 5/496 |

FOREIGN PATENT DOCUMENTS

| | | | |
|---|---|---|---|
| 837297 | 2/1939 | France | 5/471 |

*Primary Examiner*—Alexander Grosz
*Attorney, Agent, or Firm*—Romney, Golant, Martin, Disner & Ashen

[57] ABSTRACT

A continuous thin cushion is provided with stiff backing sections, arranged to align with the sections of an underlying conventional articulated hospital bed. The combination of cushion, backing, and preexisting hospital bed has a desired composite degree of firmness, ideal for orthopedic patients with back problems. Suitable covering and attachments to the bed are provided. Inexpensive materials and methods make the unit economically disposable.

18 Claims, 4 Drawing Figures

DISPOSABLE ORTHOPEDIC OVERMATTRESS FOR ARTICULATED BEDS

BACKGROUND OF THE INVENTION

1. Field

Our invention is in the field of bed accessories, and particularly relates to an application for relieving the adverse effects of inadequate hospital-bed mattresses upon orthopedic patients who have back problems.

2. Prior Art

A normal hospital-bed mattress is relatively inadequate for an orthopedic patient being treated for spinal disorder. Even when new, a mattress designed for the average hospital patient is too soft or compliant for the back-trouble patient. Such a mattress does not adequately transmit the firmness of the underlying bed frame and panels to support the patient's spine. On the other hand, a mattress suitable for a patient with back trouble would be too firm or stiff and thus a problem for most other patients.

One approach to these varying requirements would be to use specially made mattresses, offering firm support, for orthopedic patients with bad backs—while using normal mattresses for other patients. However, in hospital use this would normally be considered impractical. It would entail relatively frequent interchange of mattresses, because the beds even in an orthopedic ward are used in turn by patients with and without spinal complaints. Since mattresses are both quite heavy and quite bulky, the option of using different mattresses would call for added labor, storage facilities and possibly special equipment—all costly and complicating factors unacceptable in most hospitals.

An additional major problem area arises from the fact that a typical hospital bed has an articulated frame permitting upward tilting of the frame portion beneath the patient's back and head; it may also have a stationary horizontal portion beneath the patient's buttocks, an upward tilting of the portion beneath the patient's thighs, and a downward tilting of the portion beneath the patient's lower legs. Usually a rigid or semirigid panel spans each frame section, so that when the sections are all horizontal the bed resembles a segmented tabletop. Typically the mattress of such a bed is continuous and simply is disposed atop the articulated frame and panel where it must bend or fold to accommodate the articulated action of the frame and panels.

The mattress is subject to deterioration from use, particularly in the area where it bends, due to repeated flexure and disintegration of the padding material and springs. Interacting with this flexture and disintegration are the weight distribution and movements of a patient lying on the mattress. The padding, as a result, seems to migrate; whatever the mechanism, it forms lumps and soft areas and provides uneven and inadequate support for the patient. While this condition is not confined to the bending area, it is most severe there.

In that same area the rubberized or plastic mattress cover tends to develop ripples or creases which then become relatively permanent. These creases add to the patient's discomfort through chafing and may actually cause abrasions; to escape the concentrated effects of the creases on a particular part of the body the patient may shift into an awkward position in which the body is not properly supported—leading inevitably to even greater and more-fundamental discomfort.

All of these effects are exacerbated for back patients, especially if protracted confinement is required. In such a case it is essential to maintain generally uniform support for the length of the spine. In particular, if the lower part of the spine is not adequately supported relative to the upper portion, the spine tends to bend or distort.

Even a relatively thin foam pad placed directly on the hard metal tabletop-like surface of a typical articulated hospital bed would be preferable to the deteriorated normal mattresses found on such beds. However, such a solution (as with the mattress-changing technique described above) is impeded by the costs of mattress moving and storage.

The prior art reflects efforts to overcome these problems, but teaches away from the concepts of our invention—some of the oldest art presenting the most similar structure, though the similarity is superficial.

U.S. Pat. No. 46,569, issued Feb. 28, 1865 to R. H. Mathews illustrates a portable "bedstead" for use of invalids, and for maternity cases in actual delivery. This "bedstead" comprises a continuous, relatively thin cushion and an articulated thin backing secured to the cushion, providing easy means for the attendant or physician to maneuver the patient between lying and sitting positions. Foot-blocks, and handles for use by either the patient or attendant, are included. For carrying, the apparatus folds into a configuration which is quite compact; it has straps for securing it in the folded configuration and handles for carrying it in that condition. The device is described as "put . . . into use by laying it on a common bedstead or any article that will sustain it"—i.e., likely a flat bedstead, workbench or the like.

The folding action of Mathews' device is not coordinated with that of any underlying articulated bedstead, if indeed such beds were then in general use or even general hospital use. To the contrary, the inventor noted that his "sick bed or frame [could] be converted into the form of a chair by shifting it, with the patient thereon, toward the edge or side of the bedstead on which it lies, so as to allow the legs of the patient to hang down, the feet resting on the foot-blocks . . . . The handles . . . afford every facility in moving and turning the frame with its burden without touching the patient." In short, Mathews' structure was not directed to the same purposes as the present invention, and accordingly its details reflect different constraints, as will be seen.

Composites of cushioning and backing materials for various purposes are of course well-known, an early example of modern technology appearing in British Pat. No. 490,461, which issued Jan. 11, 1937 to F. De. Lautour: "A sheet or board of gas-expanded rubber or rubber-like materials is faced on one or both sides with a wood-veneer or plywood board."

Somewhat more closely related purposes characterize the inventions of A. W. Schenker, protected under U.S. Pat. Nos. 2,373,421 and 2,469,084, issuing respectively Apr. 10, 1945 and May 3, 1949 and described as "body resting appliances." These inventions involve combined cushioning and thin reinforcing materials, forming a composite structure for comfort and for spinal or other skeletal therapy. The special feature of Schenker's inventions seems to be custom molding of the reinforcing material to the contours of a particular patient's body, for optimum stress distribution and skeletal support.

The later of Schenker's patents discloses a version which is articulated in the manner of a conventional hospital bed, the reinforcement being embedded between two cushioning layers which produce overall thickness generally comparable to that of a conventional mattress.

Schenker's inventions thus are intended to substitute for existing conventional hospital mattresses rather than to cooperate with, and extend the beneficially useful lives of, such already-existing mattresses. In these ways Schenker's inventions are distinguished, as will be seen, from ours.

More-modern approaches to the problem of deteriorating hospital bedding are seen in U.S. Pat. Nos. 3,188,660 and 3,249,952, issued respectively June 15, 1965 to Y. R. Guttman and May 10, 1966 to M. N. Janapol.

Guttman contributes the concept of sectionalizing the mattress cushion itself at one point, to match the principal articulation of the bed frame. This approach reduces the flexure of the padding material in that area, expectably reducing to an extent the formation of lumps and pockets. But Guttman does not reduce the component of the mattress disintegration which results from the interaction of the patient's weight and movements with the mattress-section tilting; eventually this too causes the mattress to become lumpy. Moreover, unless extreme care is taken to position the mattress sections properly and monitor their condition, over the long term the separate edges of the mattress sections which are exposed where they abut at the base of the patient's spine, and are subject to at least slight misalignment, may produce as much patient discomfort and eventual spinal distortion as a conventional unitary mattress, if not more.

Janapol's technique is to facilitate articulation of the mattress without actually separating it into distinctly fabricated sections. He teaches drawing down or retracting the padding material of the mattress into a laterally extending recess in the frame, at the point of the principal hinge; and separating the mattress padding into layers with low-friction interfacing, so that the layers slide upon each other rather than catching, bunching and wrinkling. By this construction the inventor purports to control the flexure and consequent disintegration of the padding. Without evaluating the merits of this design, one may see immediately that it is a very different kind of solution to the hospital-bed problem from our invention.

A possibly closer relative in that it supplements an existing mattress in an "egg-crate foam" overlay intended to be placed on top of an existing hospital mattress. This overlay is a large piece of plastic foam, molded into a cellular structure reminiscent of the paper-fiber separators used in crating eggs. The "egg-crate foam" does not include any type of firm backing or stirrener. Thus this construction may provide a softer support for delicate skin, rather than firming or stiffening the support, and thus offers a teaching directly contrary to that of our invention, while serving very different purposes.

SUMMARY OF THE DISCLOSURE

A continuous, compact cushion, of generally the same horizontal dimensions as the mattress of a conventional sectional hospital-bed, is provided with stiff backing elements and with attachment means. The cushion is substantially thinner than such a conventional mattress, and disposable (that is to say, less expensive, and suited for more-temporary use than such a mattress). The backing elements are stiff fiberboard such as that sold under the trademark Masonite, wood, plastic or other relatively inexpensive material. They are secured to the underside of the cushion in such a way that certain edges of the backing elements will be approximately in alignment with edges of the sectional bed frame. Thus the overmattress is articulated in correspondence with the bed frame. As will be seen, this does not mean that the lengths of the articulated overmattress backing elements are exactly the same as the bed-frame sections: certain differences are introduced by the thickness of the conventional mattress in cooperation with the mutual angling of adjacent bed-frame sections. Moreover, certain backing elements may be eliminated, or truncated to a fraction (but a significant fraction such as one-half or one-third) of the length of the corresponding bed section.

The cushion and backing elements are of a compliance and stiffness, respectively, selected to cooperate with the support supplied by a conventional hospital-bed surface and mattress, to attain a desired composite degree of firmness. The composite firmness is relatively insensitive to the degree of deterioration of the conventional mattress, though that mattress and the underlying bed surface do contribute somewhat to the characteristics of the combination.

In particular, the backing elements need not be extremely rigid, for they are not called upon to span the bed frame unaided. The backing elements are supported by the rigid tabletop-style surface of the bed, through the intermediary of the conventional mattress. Consequently the backing elements need only be stiff enough to compensate for a considerable fraction of the undesirably excessive compliance of the intervening mattress. Not all the mattress compliance need be overcome: a certain limited amount of flexure in the backing elements is acceptable and perhaps even adds to patient comfort.

The interaction of these various considerations means that the backing elements can advantageously be made thin, and thus inexpensive, while helping to provide virtually ideal composite firmness.

The attachment means comprise either straps for attachment to the articulated frame or support-panel sections of the bed, or a fabric sheeting structure, similar to the lower part of a contoured bedsheet, for attachment to the mattress of the bed. In either case the attachment means are advantageously integral with sheeting which covers the cushion and may encircle or completely enclose it.

Particular details and additional features of the invention will be seen from the following discussion and drawings, in which:

BRIEF DESCRIPTION OF THE DRAWINGS

FIG. 4 is an isometric view of yet another variant, partly cut away.

GENERAL DESCRIPTION OF PREFERRED EMBODIMENTS

Figure 1:
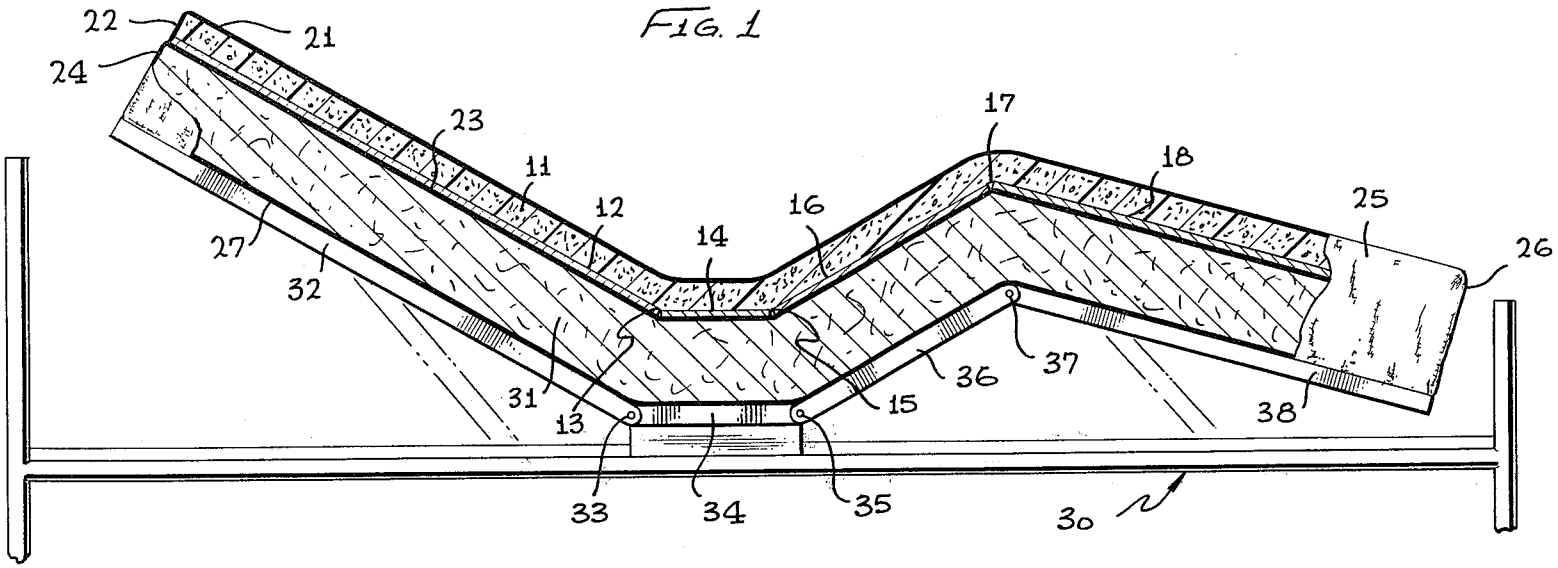
FIG. 1 is a side elevation of a presently preferred embodiment of our invention, shown in conjunction with a conventional hospital bed, and partly in cross-section.

As shown in FIG. 1, a cushion 11—having generally the same horizontal dimensions as a conventional mattress 31—has secured to its underside a plurality of stiff backing members 12, 14, 16 and 18, narrowly separated from one another at 13, 15 and 17. Though not clear from the drawings, the width of the cushion 11 generally matches the width of mattress 31 as well as its length; and the widths of the backing members 12, 14, 16 and 18 likewise generally match the widths of the cushion 11 and mattress 31. It is anticipated that the mattress 31 in turn will be disposed upon an articulated support or frame having longitudinal members 32, 34, 36 and 38, with pivots 33, 35 and 37 at the mutually abutting edges of the support or frame members. It is to be understood that the mattress 31 and support or frame sections are shown only generally and by way of example, as they represent a typical prior-art conventional hospital bed.

In a typical hospital bed of this sort, bed sections 32, 34, 36 and 38 are not merely framework members but are support panels, continuous transversely across the full width of the bed and continuous longitudinally along substantially their full respective lengths—e.g., for section 36, from pivot 35 to pivot 37. However, the principles of our invention are also applicable to beds having framework members 32, 34, 36 and 38 spanned by transverse mattress-supporting springs, or any of various equivalent structures.

Likewise in a typical bed of this sort the buttocks-support section 34 is horizontal and stationary, and the other sections 32, 36 and 38 are operable manually or by one or more motors to accommodate the preferences of a person lying on the mattress. However, the principles of our invention are also applicable where the section 34 too is manipulable, or is omitted entirely so that the bed has only three support sections 32, 36 and 38 (with sections 32 and 36 being pivoted together, of course), or the sections 34 and 38 are both omitted so that the bed has only two support sections 32 and 36 joined at a single pivot—or indeed any like variation on the general idea of a bed articulated for patient comfort or therapeutic purpose.

It is necessary that the separations or joints 13, 15 and 17 be properly spaced apart with respect to the two ends of the cushion 11 and the frame pivots 33, 35 and 37 and the two ends of the mattress 31, so that when the bed sections are mutually angled as shown the joints 13, 15 and 17 will naturally be positioned or positionable upon the concave and convex folds of the mattress 31, respectively.

Proper design requires that (1) the joints be so positionable when the bed sections are tilted at the maximum angles permitted by the mechanism, (2) the joints are positionable to reasonably accommodate all lesser tilt angles, and (3) when the overmattress is placed on the bed so that the first two conditions are met, the ends of the overmattress do not extend excessively beyond the end of the mattress—even with all the bed sections horizontal.

When the overmattress is designed in this way and properly positioned over the mattress and bed, the joints 13, 15 and 17 may be referred to as "functionally aligned" with the bed pivots 33, 35 and 37—though they are not, of course, aligned with the pivots in a literal sense.

The lengths of the backing members of course must be worked out for each bed model, taking into account the thickness of the mattress (interposed between the support members of the bed and the backing members of the overmattress) and the maximum or typical angles between the bed sections. For example, starting with a geometrical calculation, where the stationary section 34 of the bed is 9½ inches long, the head section 32 tilts to a maximum 60° and thigh section 36 to 26°, and the mattress 31 is 7 inches thick, the corresponding backing member 14 should be somewhat under 4 inches long. However, it is advisable to make actual measurements of the desired lengths with the bed sections angled, since the flexing behavior of the particular mattress model may disturb a purely geometrical analysis.

While it is desirable that the cushion 11 be generally the same length as the mattress 31, it will be apparent that slight variations from the mattress length may be appropriate for various purposes, and shall not be supposed to take a particular structure outside the scope of the appended claims. For example, it may be desirable to make the foot end of the cushion (the portion above backing member 18 and bed section 38) slightly shorter than the foot end of the mattress 31, as this may in some circumstances help to prevent protrusion of the cushion beyond the end of the mattress foot when the bed sections 32, 34, 36 and 38 are all aligned horizontally, without the necessity of the entire cushion 11 and backing members 12, 14, 16 and 18 sliding toward the head of the bed.

The portion of the illustrated structure near the principal hinge 33 is the most critical portion. That is, the ends of the backing members 12 and 14 near the joint 13, and reasonably close spacing at the joint 13, are important to the effective use of our device. The other ends of these two backing members 12 and 14, and the backing members 16 and 18 in their entirety, may be respectively truncated or eliminated without severely interfering with the major benefits of the invention. That is to say, for example, the backing member 16 could extend only from the illustrated joint 15 a significant fraction of the way (such as a third of the way or halfway) to the illustrated position of joint 17, and the member 18 be omitted entirely, while still retaining the major advantages of insensitivity to mattress condition above the principal hinges 33 and 35. Even the head-end third of member 12 could be omitted without severe loss of advantage.

However, to most-fully enjoy the benefits of our invention we prefer to provide a cushion 11 and backing elements 12, 14, 16 and 18 which are generally full-length as illustrated.

The cushion 11 and backing members 12, 14, 16, and 18 are to be made of inexpensive materials, so that the overmattress which they make up can be considered disposable when it no longer serves the purpose of orthopedic aid intended. As already noted, the backing may be of such material as wood, fiberboard such as that sold under the trademark Masonite or plastic; the cushion 11 may be of a compliant, resilient material such as foam plastic or rubber. The attachment of backing to the cushion may be accomplished by glue, snaps, straps, or other suitable means as preferred. The specific thicknesses and other characteristics of the backing elements and cushion are preferably chosen so that in combination with the mattress 31 the overmattress provides a composite degree of firmness and compliance which is nearly optimal for orthopedic effect, and in particular is insensitive to the exact extent of deterioration of the underlying mattress 31. By way of example, we have found that about three and one-half inches of polyurethane foam, having compliance characteristics sometimes commercially described as "load-deflection rating of 40 ILD," in combination with roughly one-eighth inch of masonite, serves well for a variety of conventional hospital beds. It further appears that the combination of about two inches of firmer polyurethane foam with a rating of 80 ILD, in combination with about one-eighth inch masonite will be effective and less costly. Allowing for substitution of various types and qualities of materials, serviceable backing thickness would likely be in the general range one-eighth to one-half inch and serviceable cushion thickness would be in the general range of two to four inches. It is desirable to make suitable provision for securing the cushion and backing members to the bed—that is to say, either to the bed sections 32, 34, 36, 38 or to the conventional mattress 31, or both. Likewise it is desirable to provide for covering the material of the cushion to keep it clean and also to prevent that material from crumbling and shedding in the area of the bed. Some materials are uncomfortable or may be unsafe when in protracted human skin contact, or near-contact where separated only by an ordinary bedsheet. Consequently the preferred embodiments of our invention comprise both attachment and covering means.

One suitable embodiment (not illustrated) comprises straps or the like securing the backing members 12, 14, 16, 18 to the corresponding support panel or frame sections 32, 34, 36, 38; and enclosing the cushion and backing members in flexible sheeting which is perforated for passage of the straps.

However, we have found it particularly advantageous to combine these two functions—attachment and covering—in a single element, namely a flexible sheeting of relatively heavy woven fabric or of moisture-impermeable material such as plastic or rubber, having an extremity which is long enough and suitably formed to extend beneath the conventional mattress or around part of the bed section. Such a sheeting is illustrated in FIG. 1, as having upper surface 21 above the cushion 11, intermediate surface 23 below the backing members 12, 14, 16 and 18, and end surface 22 (and the upper part of 26)—which completes a compartment completely enclosing the cushion and backing elements. The sheeting also has a lower skirt 24, 25, 26 which in the manner of a contoured sheet extends as at 27 underneath the conventional mattress 31, but only a short distance in from the edge of the mattress 31 all the way around that mattress. That is, the under-portion of skirt 27 appears similar to the under-portion 127 of skirt 125, 126 of FIG. 2. For clarity, the thicknesses of all these sections of sheeting are exaggerated in the drawings.

Figure 2:
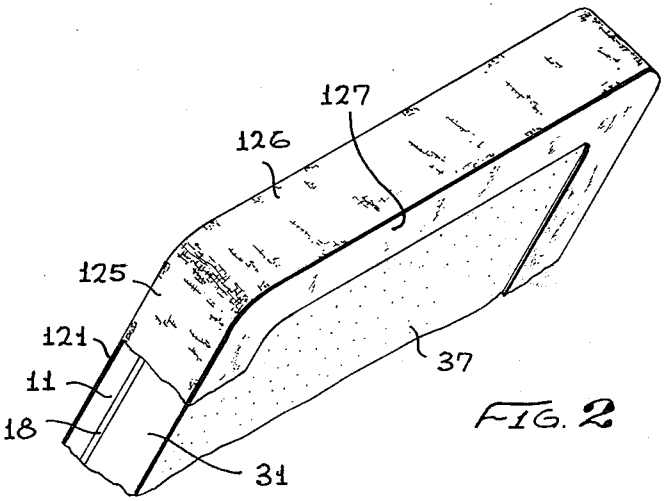
FIG. 2 is an isometric view of part of a variant of the embodiment of FIG. 1, partly cut away.
Figure 9:
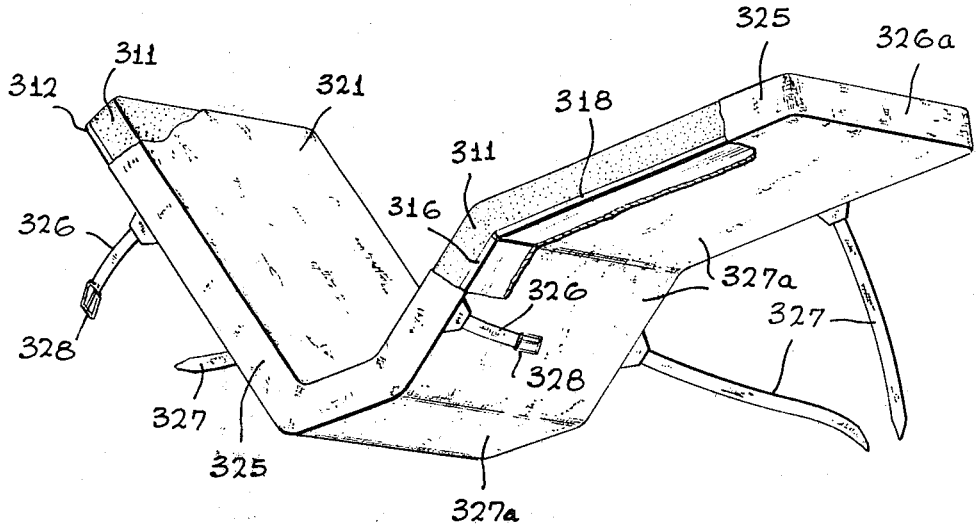

It will be apparent that a great number of variations on this arrangement are possible. For example, the end-panels 22, 24 and 26 can be partly or entirely omitted without losing the attachment to the mattress or the isolation of foam from human skin. In other words, the sheeting can encircle, without enclosing, the foam and backing. Another variant is to retain the end-panels but eliminate the intermediate surface 23, so that the foam and backing are covered without being even encircled. This is illustrated in FIG. 2, where the sheeting is formed as an extra-deep contour sheet, with deep side panel 125 and end-panel 126, top surface 121, and underportion 127 below the bottom surface 37 of mattress 31. The cushion 11 and backing members (exemplified by foot-end member 18) are the same as in FIG. 1.

Figure 3:
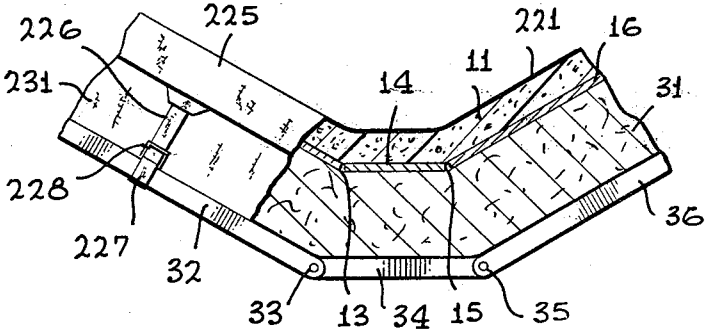
FIG. 3 is a side elevation of part of another variant of the embodiment of FIG. 1, also partly in cross-section.

Yet another possibility is to make the extremity of the sheeting a pair of straps or other distinctly shaped or manufactured elements, such as 226, 227 in FIG. 3, rather than skirting such as 24, 25, 26 in FIG. 1 or 125, 126 in FIG. 2. In FIG. 3 the cushion 11 and backing elements (such as exemplified by elements 14 and 16 in the figure), and the bed sections (such as 32, 34 and 36, with pivots 33 and 35, in the figure), are all the same as in FIG. 1. Here, however, the sheeting consists only of top surface 221, side surface 225, downwardly extending strap 226, and another strap 227 which engages the first strap 226 and fastens as at 228. The other strap 227 is attached to the sheeting 225, at an attachment point (not shown) on the opposite side of the bed, in the same manner as strap 226 is attached at the side illustrated. From its unillustrated attachment point, strap 227 extends downwardly, passes beneath support or frame section 32 to the illustrated side of the bed, then extends upwardly to the buckle or other fastener 228. The two straps 226 and 227 together may be regarded as an attachment or securing extremity of the sheeting. In practice of course there would be a plurality (generally at least one for each of the movable sections 32, 36 and 38) of such attachment or securing extremities.

Sheeting 225 and mattress cover 231 are cut away in FIG. 3 to show that the underlying items are the same as in FIG. 1.

FIG. 4 shows an arrangement similar to FIG. 1 In that the cushion 311, with backing elements including 312, 316 and 318, is completely enclosed by the sheeting, which in this case comprises top portions 321, bottom portions 372*a*, end panel 326*a*, side panel 325, and of course the other end and side panels not visible in the view. The arrangement of FIG. 4 is, however, also similar to that of FIG. 3 in that the extremity of the sheeting is a plurality of strap pairs 326, 327 with fasteners such as 328, for securing the overmattress to the conventional hospital bed.

The sheeting (whether configured as at 21, etc. in FIG. 1, 121 etc. in FIG. 2, or 221 etc. as in FIG. 3, or 321 etc. as in FIG. 4, or otherwise) may if preferred for patient comfort be of a woven fabric. The fabric should be heavy enough to provide some slight distribution of the patient's weight over the foam but coarse enough to "breathe" and thereby minimize the problem of poor ventilation of the skin, and resultant bed-sores. Ordinary cotton mattress "ticking" or covering material may be suitable for this purpose.

Because the overmattress is only intended for temporary use, in many cases the desirability of protecting the foam from moisture, liquid food products, or body wastes may become a minor consideration; in such cases, woven fabric suffices. In other cases a moisture-impervious sheeting may be used. The various sheeting panels such as, for instance, 21, 22, 23, 24, 25, 26, and 27 in FIG. 1 need not all be of the same material.

All of the details presented here are offered merely as examples, and not intended to limit the scope of our invention, which is to be determined from the appended claims.

We claim:

1. A low-cost, light-weight disposable orthopedic overmattress, for use in conjunction with a hospital-style articulated bed having at least three rigid sections hinged together at their mutually abutting edges and having a conventional mattress disposed upon such rigid sections, said rigid sections including a stationary middle section, and movable upper and lower sections, said overmattress comprising:

continuous, compliant but firm cushion means for substantially directly supporting a person, said cushion means comprising polyurethane foam having a load deflection rating of about ILD 80, and being from about two to about three inches in thickness, and generally the same length and width as, but substantially thinner than, such conventional mattress; and means for supplementing the support provided by said conventional mattress for supporting orthopedic patients having back problems, said means including a plurality of stiff backing plates including at least a middle, an upper and a lower plate, one plate for each rigid section of an articulated bed, said plates being composed of a rigid material, and being permanently secured in a sequence along the underside of the cushion means, each plate having generally the same width as the cushion means; the lengths of the backing plates and their positioning longitudinally along the cushion means being for functional alignment with such mutually abutting edges of such bed sections;

said middle plate being substantially the same length as the middle section of an articulated bed, each of two opposite edges of said middle plate being disposed in close proximity to one edge of said upper and lower plates, respectively, the length of each of said upper and lower plates being shorter than the corresponding upper and lower sections of said bed;

the stiffness of the backing plates and compliance of the cushion means being adapted to cooperate with a conventional mattress and rigid bed sections to attain a desired composite degree of firmness.

2. The overmattress of claim 1, also comprising means for securing the cushion and backing plates to such bed.

3. The overmattress of claim 1, also comprising means for covering the cushion.

4. The overmattress of claim 3, also comprising means for securing the cushion and backing plates to such bed.

5. The overmattress of claim 4 wherein a flexible sheeting, having an extremity adapted to extend beneath such conventional mattress, functions as both the covering means and securing means.

6. The overmattress of claim 5 wherein the extremity adapted to extend beneath such mattress comprises a strap adapted for fastening to such bed.

7. The overmattress of claim 5 wherein the flexible sheeting comprises a band encircling the cushion and backing plates.

8. The overmattress of claim 5 wherein the flexible sheeting comprises a compartment completely enclosing the cushion and backing plates.

9. The overmattress of claim 5 wherein the extremity adapted to extend beneath such mattress comprises a contoured lower section of the sheeting adapted to fit around the edges of such conventional mattress in the manner of a contoured bedsheet, thereby to secure the cushion and backing plates to such bed.

10. The overmattress of claim 9 wherein the flexible sheeting also comprises a band encircling the cushion and backing plates.

11. The overmattress of claim 9 wherein the flexible sheeting structure also comprises a compartment completely enclosing the cushion and backing plates.

12. The overmattress of claim 3 wherein the covering means comprise woven fabric.

13. The overmattress of claim 3 wherein the covering means comprise sheeting of a water-impermeable material.

14. The disposable overmattress of claim 3 wherein the covering means are adapted to be separable from the cushion and backing plates, to facilitate cleaning or reuse of the covering means.

15. The disposable overmattress of claim 3 wherein the covering means are permanently secured to the cushion or backing plates.

16. The overmattress of claim 1, wherein the backing plates are secured by glue to the cushion.

17. The combination of claim 1 wherein the backing plates are made of a material selected from the group consisting of fiberboard, plastic and wood.

18. A low-cost, light-weight disposable orthopedic overmattress, for use in conjunction with a hospital-style articulated bed having at least three rigid sections hinged together at their mutually abutting edges and having a conventional mattress disposed upon such rigid sections, said rigid sections including a stationary middle section, and movable upper and lower sections, said overmattress comprising:

continuous compliant cushion means for substantially directly supporting a person, said cushion means being polyurethane foam having a load deflection rating of approximately ILD 80, and being between about two and about three inches thick, and generally the same length and width as such conventional mattress;

means for supplementing the support provided by said conventional mattress for supporting orthopedic patients having back problems, said means including a plurality of stiff backing plates including at least a middle, an upper, and a lower plate for support by a conventional mattress, one plate for each rigid section of an articulated bed, said stiff backing plates composed of a material selected from the group consisting of fiberboard, wood and plastic, said material being between one-eighth and one-quarter inch thick and each plate having generally the same width as the cushion means; said cushion means overlying and permanently secured to said backing plates; the backing plates being positioned longitudinally along the cushion for functional alignment with such mutually abutting edges of said middle, upper and lower bed sections;

said middle plate being substantially the same length as said middle section of an articulated bed, each of two opposite edges of said middle plate being disposed in close proximity to one edge of said upper and lower plates, respectively, the length of each of said upper and lower plates being substantially shorter than the corresponding upper and lower section of an articulated bed;

sheeting of flexible cover material adapted to cover the cushion means and having means adapted to secure the cushion means and backing plates to such bed.

* * * * *